United States Patent [19]

Mullins et al.

[11] 4,453,846

[45] Jun. 12, 1984

[54] MINE EQUIPMENT

[75] Inventors: Rex Mullins, Burton-on-Trent; David Brenkley, Chaddesden, both of England

[73] Assignee: Coal Industry (Patents) Limited, London, England

[21] Appl. No.: 329,104

[22] Filed: Dec. 9, 1981

[30] Foreign Application Priority Data

Jan. 20, 1981 [GB] United Kingdom ..... 8101617

[51] Int. Cl.[3] ..... E21D 23/12

[52] U.S. Cl. ..... 405/299; 299/1; 405/302

[58] Field of Search ..... 405/291, 299, 300, 301, 405/302; 299/1, 31, 33

[56] References Cited

U.S. PATENT DOCUMENTS 4,089,182 5/1978 Takahashi et al. ..... 405/299
4,091,627 5/1978 Takahashi et al. ..... 405/229 X

FOREIGN PATENT DOCUMENTS 1002844 9/1965 United Kingdom .
1004275 9/1965 United Kingdom .
1095543 12/1967 United Kingdom .
1109836 4/1968 United Kingdom .
1123975 8/1968 United Kingdom .
1160379 8/1969 United Kingdom .
1210069 10/1970 United Kingdom .
1472557 5/1977 United Kingdom .

*Primary Examiner*—David H. Corbin
*Attorney, Agent, or Firm*—James C. Wray

[57] ABSTRACT

This invention provides mine equipment for sensing the advance of mobile equipment, particularly on longwall face conveyors the equipment comprises two mine roof supports provided with sensor means for sensing relative movement between the associated roof supports and an elongate bar component secured to the conveyor and extending between the two supports in a direction rearwardly of the conveyor. The elongate component is magnetized so that a magnetic field is induced adjacent thereto, the induced magnetic field intensity varying longitudinally of the elongate component.

13 Claims, 2 Drawing Figures

MINE EQUIPMENT

Figure 1:
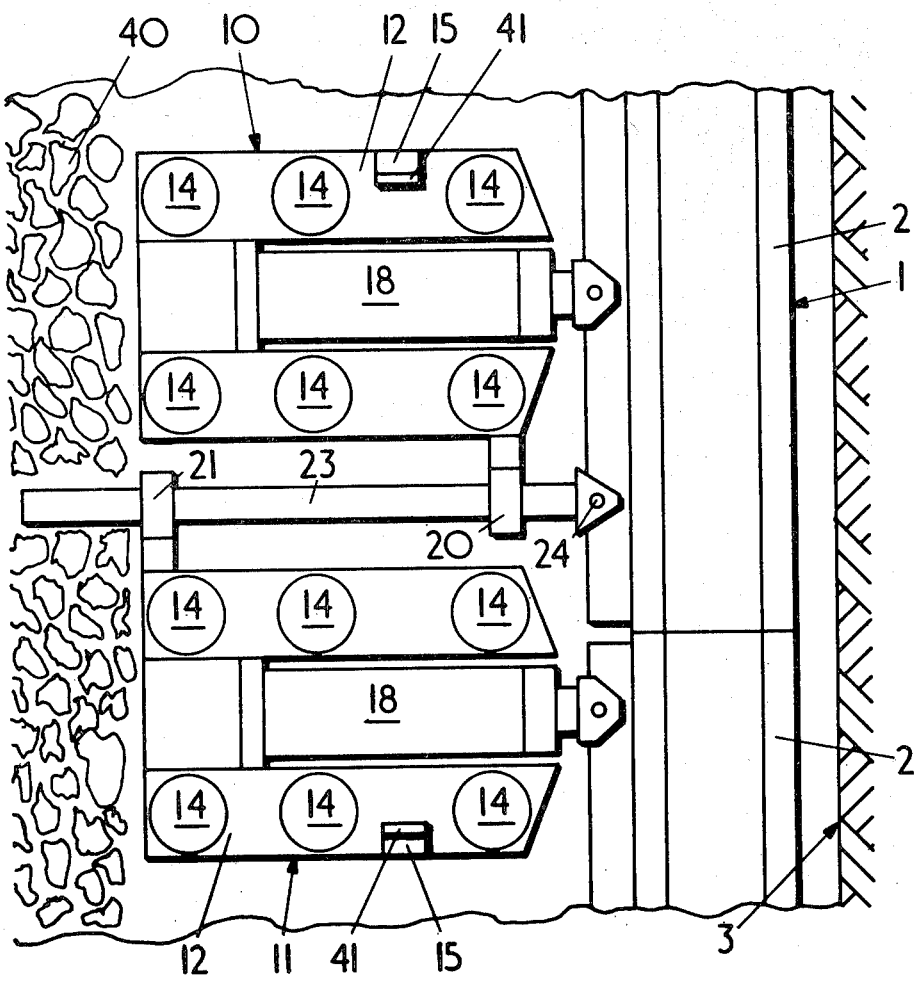

This invention relates to underground mine equipment and in particular to underground mine equipment for measuring the advance of a longwall face conveyor comprising a plurality of articulatedly connected conveyor sections.

Prior known equipment for measuring the advance of a longwall face conveyor is described and claimed in our British patent specification Serial No. 1,472,557 in which claim 1 defines mine equipment for measuring the advance of a longwall face conveyor including a plurality of articulatedly connected sections, comprising first and second components adapted to be releasably anchored adjacent to a mine goaf behind the conveyor, each of the components being capable of being advanced relative to the other component, control means for controlling actuation of the components such that, in use, each of the components is advanceable only when the other component is anchored, and sensor means associated with both the components and sensitive to movement of at least one of the components relative to the component. In the described embodiment each of the components comprised a roof support and the sensor means included a linear transducer connected at its ends to the roof supports, respectively and arranged to give a continuous accumulative indication of the total relative movement of one of the components relative to the other component.

Unfortunately, the conveyor is not anchored completely at any time and therefore not only can it move when it is actually being advanced but also it can be pulled back by the roof supports as they are sequentially advanced. In addition the reaction forces generated by the passage of a mineral winding machine along the conveyor can be sufficiently large to displace the conveyor. Moreover, the anchored roof supports which provide the reference points for the measurements of conveyor advance cannot be relied upon totally as when the conveyor is being advanced the reaction on a poorly installed support on one installed in broken strata can lead to displacement of the support.

An object of the present invention is to provide improved mine equipment for measuring the advance of a longwall face conveyor, which tends to overcome or reduce the effects and problems associated with the above mentioned conditions.

According to the present invention mine equipment for measuring advance of mobile equipment comprises a releasable stay component adapted to be releasably anchored adjacent to the mobile equipment, in use the released stay component being capable of being advanced relative to the mobile equipment, an elongate component securable to the mobile equipment such that in use it extends rearwardly of the mobile equipment relative to the direction of advance and is movable only with the mobile equipment, and sensor means associated with the stay component and adapted to sense relative movement of the components.

Preferably, the elongate component is magnetised such that a magnetic field is induced adjacent thereto, the induced magnetic field intensity varying longitudinally of the elongate component.

Advantageously, the sensor means comprises a magnetic detector.

Conveniently, the mine equipment comprises two releasable stay components each adapted to be releasably anchored adjacent to the mobile equipment and each being capable of being advanced relative to the other.

Preferably, sensor means are associated with each of the releasable stay components.

Conveniently, control means are provided for controlling actuation of the releasable stay components such that, in use, each of the stay components is advanceable only when the other stay component is anchored.

Preferably, each stay component comprises a ram for connecting the support to the conveyor.

Advantageously, the control means ensures that only one ram on each pair of stay components is actuated to advance the conveyor relative to the supports.

Figure 2:
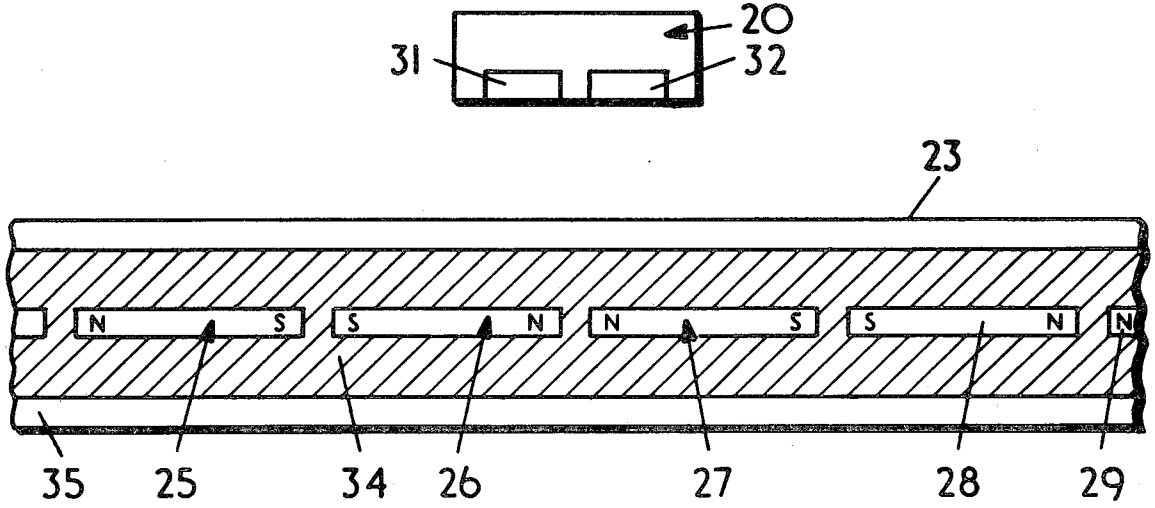

By way of example, one embodiment of the present invention now will be described with reference to the accompanying drawings, in which:

FIG. 1 is a diagrammatic plan of mine equipment constructed in accordance with the present invention in an operational position; and FIG. 2 is a diagrammatic view of a detail of FIG. 1 shown on an enlarged scale.

FIG. 1 shows a plan of a longwall face armoured conveyor 1 comprising a plurality of articulatedly connected mobile equipment sections 2 (only the adjacent ends of two of which are shown). In use, the conveyor is arranged along the full length of the longwall face adjacent to the vertical working face 3 from which coal is won by a mineral winning machine (not shown) arranged to repeatedly traverse to and fro guided by the conveyor 1. Upon each strip of coal being won from the coal face the conveyor is advanced towards the newly exposed face as will be explained later in this specification.

A plurality of mine roof supports are installed adjacent to the rear or goaf side of the conveyor, ie the side of the conveyor remote from the working face 3, each of the mine roof supports comprising a floor mounted base unit, a roof engaging canopy and a plurality of upstanding hydraulically actuated props or legs installed between the base unit and the canopy. In addition each mine roof support comprises a hydraulically actuated ram for advancing the conveyor relative to the set roof support or for advancing the released roof support relative to the conveyor which is retained in position by adjacent set roof supports.

In FIG. 1 only two mine roof supports or releasable stay components 10 and 11 are shown. Each comprises a floor mounted base unit 12, a mine roof engaging canopy (omitted from the drawing) and six upstanding hydraulically actuated props or legs 14 mounted between the base unit and the canopy. Control means 15 are provided to control the actuation of the props or legs such that the legs are urged to extend to urge the canopy into contact with the mine roof to anchor the associated support or to urge the legs to withdraw to allow the canopy to disengage the mine to release the support. The two control means 15 are interlocked such that each of the supports can only be released from its anchored roof supporting mode when the other support is in an anchored roof supporting mode. Each control means 15 also controls the actuation of an associated double acting advancing ram 18 to urge the adjacent portion of the conveyor to advance towards the coal face 3 relative to the anchored support or to advance the released roof support towards the conveyor which is anchored under the action of adjacent set roof supports. As seen in FIG. 1 each ram 18 is secured to the goaf side of the conveyor and to the associated base unit.

Each of the supports 10, 11 is provided with sensor means 20, 21, respectively, for sensing relative movement of the associated support and an elongate component constituted by a magnetised bar 23 pivotally secured at 24 to the rear or goaf side of the conveyor and extending between the two supports in a rearward direction.

FIG. 2 shows a portion of the magnetised bar 23 and one of the sensor means 20 on an enlarged scale. The bar 23 is shown to comprise a series of spaced magnets 25, 26, 27, 28 and 29 arranged along the length of the bar such that a magnetic field is induced adjacent to the bar, the induced magnetic field intensity varying longitudinally of the bar. The magnets which are arranged end to end and magnetically spaced or isolated from each other are encapsulated in a core 34 of non-magnetic resilient material. A non-magnetic protective outer sheath 35 is provided around the core. The sensor means 20 comprises magnetic detector means comprising two laterally offset magnetic detectors, for example, flux-gate magnetometers 31 and 32 mounted on a body 37 carried on a bracket 38 rigidly secured to the base unit 12 of the associated roof support. Thus in use, relative movement between one of the supports 10 or all and the elongate bar is sensed by the sensor means which detects the resulting varying magnetic field induced in the vicinity of the sensor means and which derives signal means indicative of the sensed varying magnetic field. In the case of the magnetic detector comprising flux-gate magnetometers, the magnetometers are triggered in sequence by the passage of the magnet and signal means indicative of the operational condition of the magnetometers are derived. The sequence in which the magnetometers are triggered is determined by the direction of relative movement.

The derived signal means are fed from the associated sensor means 20 and 21 to the control means 15.

The control means 15 also includes memory and processing means 41 enabling the control means to store and update the total sensed advance of the bar relative to the supports 10 and 11. In addition, the control means 15 can communicate with a central control (not shown) arranged to receive signals from the aforementioned plurality of sets of sensing equipment to derive a plan profile of the conveyor. In operation, a plurality of sets of mine equipment as described above are arranged at desired preselected intervals along the length of the conveyor, each set being arranged to sense movement of the adjacent portion of the conveyor.

In each set of equipment the bar is pivotally secured to the rear or goaf side of the conveyor such that it is free to trail behind the conveyor between the two bases of the associated supports and into the goaf area 40 left behind the advancing longwall face.

As shown in FIG. 1 the two sensor means 20 and 21 are fixedly secured to the base unit of the associated support, each sensor means slidably accommodating the elongate bar. The sensor means 20 is secured at a relatively forwardly location on the associated base unit and the sensor means 21 is secured at a relatively rearwardly location on its associated base unit such that each mine roof support 10 or 11 can be advanced relative to the other of the supports 11 or 10 without interfering with the set support.

When it is desired to advance the portion of the conveyor 1 associated with the supports 10 and 11 towards the newly exposed coal face, the ram 18 of the support 10 is activated to push the conveyor, the ram 18 of support 11 is not activated but allows the conveyor to move freely relatively to the support 11. As the conveyor advances the total relative movement between the conveyor and the support 11 will be sensed by the sensor means 21 on the support 11. As the support 11 is not subjected to any reaction forces arising from the advance of the conveyor the support 11 is not urged to move during advance of the conveyor and the sensed relative movement therefore is a true and accurate reading.

In alternative arrangements, the roles of the supports 10 and 11 are reversed, for example, the advancing ram 18 of the support 11 is used to advance the conveyor. Alternatively, the conveyor is advanced by advancing rams on adjacent roof supports. However, in any adopted arrangements the rams or both the supports 10 and 11 are never used simultaneously to advance the conveyor.

Once the conveyor is advanced fully the supports 10 and 11 are advanced in turn and any resulting rearward movement of the conveyor will be sensed by the sensor means on the currently anchored support. Thus, during advance of the supports 10 and 11 the control means 15 ensures that only the reading from the currently anchored support is monitored. Typically, this is achieved by arranging that the control means suitably monitors the functions of the hydraulic circuit activating the legs 14 and ram 18 to determining impending movement of a support 10 or 11.

After the advance cycle is completed any further movement of the associated portion of the conveyor due to, for example, passage of the mining machine etc., is monitored by both sensor means 20 and 21. As the sensor means are arranged to sense longitudinal movement of the elongate bar in either direction the sensor means can determine whether the further sensed movement of the conveyor is towards or away from the coal face.

In order that the conveyor and supports can negotiate uneven mine floors, the sensor means 20 and 21 are mounted on the base units 12 in such a manner as to accommodate variation in the vertical relationship between bar and base. Alternatively, the bar might be constituted by a flexible but resilient material as for example, a steel wire rope or fibre glass plastic material. Care is required to ensure the steel wire rope does not magnetically shunt the field of the magnets.

In other arrangements, the control means for the two stay components may be combined into one unit, the measurement signals from both sensors being combined to give an aggregate advance. One control unit may be arranged to control a plurality of sets of mine equipment.

In other embodiments of the present invention the main control means comprises activator means for causing desired activation of the rams 18 on each of the supports provided on all the aforementioned plurality of sets of mine equipment to achieve a desired conveyor alignment.

The present invention is suitable for measuring the advance of mobile equipment other than mine conveyor.

In other embodiments of the invention the sensor means is constituted by means other than flux-gate magnetometers, for example, reed switches or hall-devices.

In other embodiments of the present invention the bar comprises a regularly distributed alternation of materials capable of offering binary discrimination to sensor head means which are adapted to sense relative movement of the bar and the sensor head means.

In still other embodiments of the invention the set of equipment comprises only one stay component, the sensor means being arranged to sense extention of the associated advancing ram 18.

We claim:

1. Mine equipment for measuring advance of mobile equipment, comprising a releasable stay component adapted to be releasably anchored adjacent to the mobile equipment, in use the released stay component being capable of being advanced relative to the mobile equipment, an elongate component securable to the mobile equipment such that in use it extends rearwardly of the mobile equipment relative to the direction of advance and is movable only with the mobile equipment, and sensor means associated with the stay component and adapted to sense relative movement of the components, the elongate component being magnetised such that a magnetic field is induced adjacent thereto, the induced magnetic field intensity varying longitudinally of the elongate component.

2. Equipment as claimed in claim 1, in which the sensor means comprises a magnetic detector.

3. Equipment as claimed in claim 2, comprising two releasable stay components each adapted to be releasably anchored adjacent to the mobile equipment and each being capable of being advanced relative to the other.

4. Equipment as claimed in claim 3, in which sensor means are associated with each of the releasable stay components.

5. Equipment as claimed in claim 4, in which control means are provided for controlling actuation of the releasable stay components such that, in use, each of the stay components is advanceable only when the other stay component is anchored.

6. Equipment as claimed in claim 5, in which each stay component comprises a ram for connecting the component to the mobile equipment.

7. Equipment as claimed in claim 6, in which the control means ensures that only one ram on each pair of stay components is actuated to advance the mobile equipment relative to the stay components.

8. Equipment as claimed in claim 1 wherein the releasable stay component is a roof support.

9. Equipment as claimed in claim 1 wherein the sensor means extends laterally from the releasable stay component and wherein the elongate component moves through the sensor means.

10. Equipment as claimed in claim 1 wherein the mobile equipment is a conveyor.

11. Mine equipment for measuring advance of mobile equipment, comprising two releasable stay components adapted to be releasably anchored adjacent to the mobile equipment and each being capable of being advanced relative to the other and relative to the mobile equipment, the stay components comprising a ram for connecting the component to the mobile equipment, an elongate component securable to the mobile equipment such that in use it extends rearwardly of the mobile equipment relative to the direction of advance and is movable only with the mobile equipment, sensor means comprising magnetic detector means associated with each of the stay components and adapted to sense movement of each stay component relative to the elongate component, the elongate component being magnetized such that a magnetic field is induced adjacent thereto, the induced magnetic field intensity varying longitudinally of the elongate component, the sensor means associated with one of the stay components being secured to a relatively forwardly location on the component and the sensor means associated with the other of the stay components being secured to a relatively rearwardly location on the component, and control means for providing controlled actuation of the releasable stay components such that, in use, each of the stay components is advanceable only when the other stay component is anchored.

12. Equipment as claimed in claim 11, in which the control means ensures that only one ram on each pair of stay components is actuated to advance the mobile equipment relative to the stay components.

13. Mine equipment for measuring advances in a conveyor comprising first and second releasable roof supports, first and second ram means having first ends connected severally to the first and second roof supports and having second ends connected severally to the conveyor, first and second sensor means respectively connected to the first and second roof supports and extending toward the second and first roof supports respectively, elongate means connected to the conveyor and extending rearward therefrom adjacent the first and second sensor means, whereby when the first releasable roof support is released from the roof and the first ram means moves the roof support with respect to the conveyor, the first sensor senses movement of the first roof support with respect to the conveyor and wherein when the first releasable roof support is connected to the roof and the first ram is extended to move the conveyor, the first sensor senses the movement of the conveyor with respect to the first roof support and wherein similar sensing occurs relative to the second roof support and the conveyor.

* * * * *